United States Patent [19]

Kamal

[11] Patent Number: 4,684,120

[45] Date of Patent: Aug. 4, 1987

[54] PICKING AND SEPARATING DEVICE FOR TRANSPORTING ONE OR MORE FABRIC PILES FROM A STACK

[76] Inventor: Nabil Kamal, 8166 St. Denis Street, Montreal, Quebec, Canada

[21] Appl. No.: 855,681

[22] Filed: Apr. 25, 1986

[51] Int. Cl.[4] ..... B65H 3/22

[52] U.S. Cl. ..... 271/18.3; 271/168

[58] Field of Search ..... 271/18.3, 168

[56] References Cited

U.S. PATENT DOCUMENTS

| | | | |
|---|---|---|---|
| 3,176,979 | 4/1965 | Engelmann | 271/18.3 |
| 3,321,078 | 5/1967 | Treiber | 271/168 X |
| 3,738,645 | 6/1973 | Gray | 271/168 X |
| 3,981,495 | 9/1976 | Bijttebier | 271/18.3 |
| 4,346,877 | 8/1982 | Doyen | 271/18 X |
| 4,444,384 | 4/1984 | Keeton | 271/18.3 |
| 4,555,102 | 11/1985 | Engle | 271/18.3 X |
| 4,613,123 | 9/1986 | Franke | 271/18.3 |

FOREIGN PATENT DOCUMENTS

| | | | |
|---|---|---|---|
| WO85/2389 | 6/1985 | World Int. Prop. O. | 271/18.3 |

*Primary Examiner*—Richard A. Schacher

[57] ABSTRACT

A picking and separating device and method of operation for picking one or more upper ones of sheet-like material, such as fabric plies from a stack. The device comprises a frame supporting a picker mechanism which is secured thereto. The mechanism has a fabric engaging member having a flat picker surface. A plurality of angulated aligned needles are movable in and out of the surface by a movable support frame. The support frame and needles are displaced along an angulated fixed axis for engaging one or more upper ones of the sheet-like material in a stack of sheet-like material.

17 Claims, 13 Drawing Figures

PICKING AND SEPARATING DEVICE FOR TRANSPORTING ONE OR MORE FABRIC PILES FROM A STACK

BACKGROUND OF THE INVENTION

1. Field of Invention

The present invention relates to a fabric picking and separating device and method of operation for picking and transporting one or more upper ones of fabric sheets from a stack thereof without disturbing the position of said fabric sheets in the stack and to deposit same at a remote location.

2. Description of Prior Art

In the needletrade industry, it is a common operation to manually separate fabric pieces from stacks and to superimpose them in substantially precise positions wherein to sew or fuse them together. For example, in the construction of collars for shirts, there are two or three fabric pieces superimposed and sewn together. Such overlapping of fabric pieces is a time-consuming job, and often the material pieces are not properly aligned before sewing, resulting in poor quality products, material loss and man/hour loss.

There exists the need to provide an automatic separating and transporting machine wherein single fabric pieces are manipulated to be superimposed in precise alignment prior to being picked and transporting to an operating station, etc. Such machine(s) should also be operated with minimum manpower, be precise, and operate at high speed and capable of being synchronized with other machines, and be capable of picking up one or more top fabric pieces from an aligned stack of such pieces without disturbing the pieces in the stack.

SUMMARY OF INVENTION

It is a feature of the present invention to provide a picking and separating device capable of picking one or more sheet-like materials from a stack of sheet-like material, and transporting same to an unloading position while maintaining the one or more sheet-like materials in precise position.

It is another feature of the present invention to provide a picking and separating device wherein the material is picked by needles and wherein the device is provided with adjustment means to adjust the position of the needles to adjust for the number of upper plies of material to be picked and transported.

Another feature of the present invention is to provide a picking and separating device which is fully automatic, which is rapid and precise in operation and which may be used in different configurations to effect many different operations.

According to a still further feature of the present invention, there is provided a method of picking and separating one or more upper ones of sheet-like material from a stack of such material and which maintains the picked sheet-like material pieces in precise position and does not disturb any of the underlying fabric pieces in the stack.

According to the above features, from a broad aspect, the present invention provides a picking and separating device for picking one or more upper ones of sheet-like material from a stack. The device comprises a frame having a picker mechanism secured thereto. The mechanism has a fabric engaging member having a flat picker surface. A plurality of angulated aligned needles are movable in and out of the surface by a movable support frame. Means is provided to displace the support frame and needles along an angulated fixed axis for engaging one or more upper ones of the sheet-like material in a stack of sheet-like material.

According to a further broad aspect of the present invention, there is provided a method of separating, picking and transporting one or more upper ones of sheet-like material from a stack of such material. The method comprises providing a frame having a picker mechanism with a plurality of aligned angulated needles movable in and out of a fabric engaging surface of the mechanism. The frame is moved downwardly along a vertical plane or the stack moved upwardly to position the fabric engaging surface pressed against an upper one of the sheet-like material in the stack. The needles are displaced out of the fabric engaging surface, at an angle, to engage predetermined upper ones of the sheet-like material in the stack. The frame is then moved upwardly or the stack is moved downwardly along the vertical plane with one or more sheet-like materials engaged by the needles to effect a transfer of the one or more sheet-like materials.

BRIEF DESCRIPTION OF DRAWINGS

A preferred embodiment of the present invention will now be described with reference to examples thereof as illustrated in the accompanying drawings, in which.

DESCRIPTION OF PREFERRED EMBODIMENTS

Figure 1:
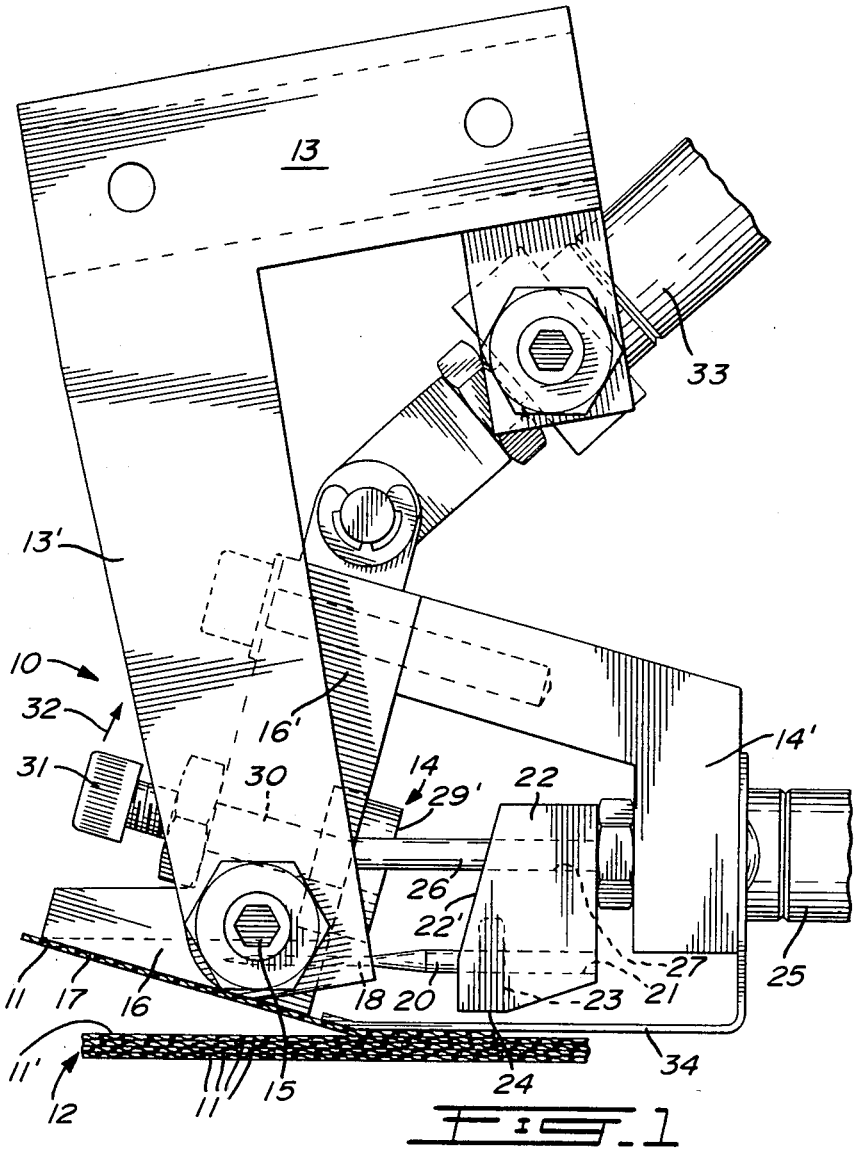
FIG. 1 is a side view, partly fragmented, of a picking and separating device of the present invention.
Figure 2:
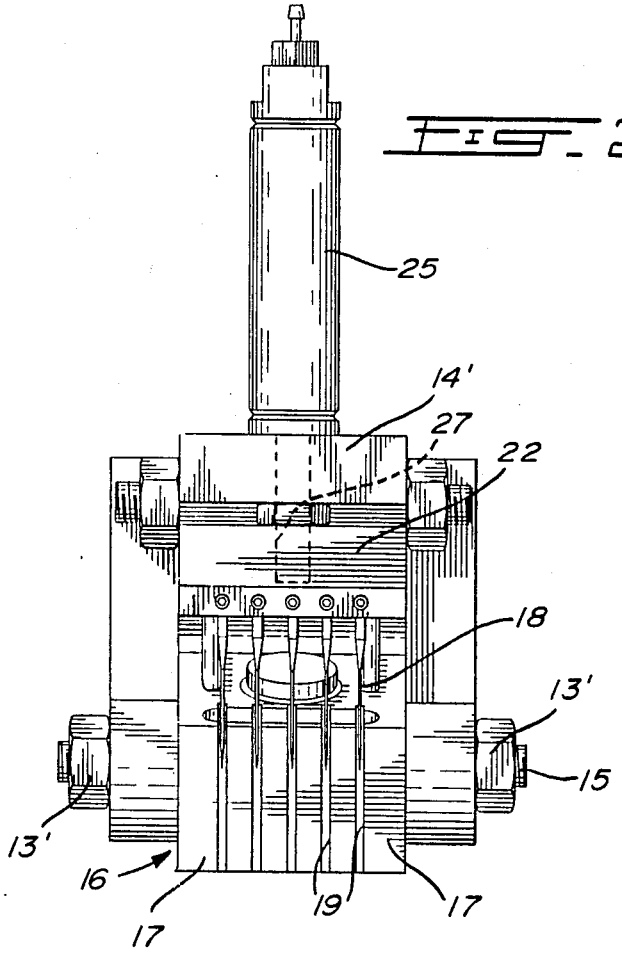
FIG. 2 is a bottom view of FIG. 1.

Referring to the drawings, and more particularly to FIGS. 1 and 2, there is shown generally at 10, a picking and separating device of the present invention for picking one or more upper ones of sheet-like material, such as fabric plies 11 from a stack 12 of such plies. The device comprises a frame 13 supporting a picker mechanism 14. As shown in the present application, the picker mechanism is hingedly connected on a pivot pin 15 secured to the bottom of a support arm 13' of the frame 13.

The picker mechanism 14 has a fabric engaging foot member 16 which is provided with a flat bottom picker surface 17 which is displaceable onto the upper surface 11' of the top plies 11 during the picking stroke of the device and applies downward pressure on the stack. A plurality of angulated aligned needles 18 are movable in and out of the bottom surface 17 of the foot member 16 and are disposed in a respective one of a plurality of equidistantly spaced slots 19 provided in the bottom surface of the fabric engaging member 16.

As shown more clearly in FIGS. 1 and 3A to 3C, the needles are each formed with a securement end 20 which is received and removably secured in a respective one of a plurality of equidistantly spaced securing bores 21 provided in a movable needle support member 22. A threaded bore 23 is provided from the bottom face 24 of the movable needle support member 22 to receive therein a lock screw (not shown) whereby to engage and retain the securement end 20 of the respective needle 18.

As shown in FIG. 1, the movable needle support frame 22 is secured to a piston 25 which is secured to a support arm 14' of the picker frame which is usually angulated on an angle ($\alpha/2+3°$) with respect to the horizontal plane of the fabric stack 12. The movable needle support member 22 is guided along this fixed angled axis by a pair of guide pins 26 which are fixed between support arm 14' and a vertical arm 16' of the fabric engaging foot member 16. These guide pins 26 extend through respective guide bushing or guide bores 27 extending through the movable needle support member 22.

Figure 3A:
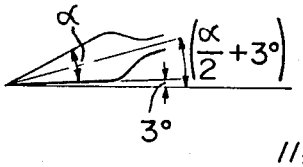
FIGS. 3A through 3C are schematic illustrations showing the operation of the picking needles.
Figure 3A:
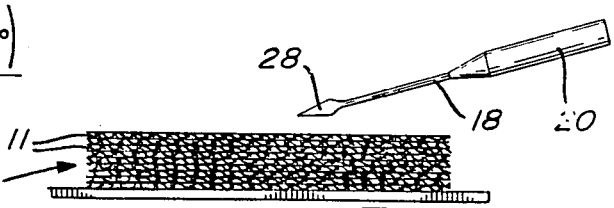
Figure 3B:
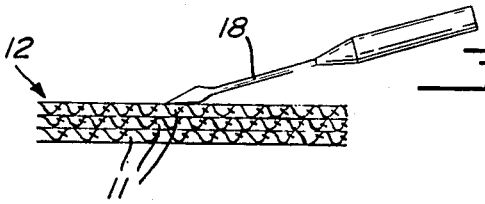
Figure 3C:
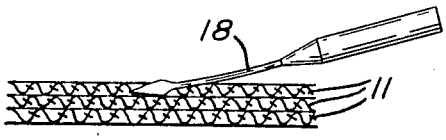

As illustrated more clearly in FIGS. 3A to 3C, the needles 18 are provided with a pointed end 28 which penetrates or dives into the upper plies 11 of the fabric stack 12 when the needle is advanced during the diving stroke of the piston 25. The free end portion of the needle 18 will have a tendency to bend slightly, as illustrated in FIG. 3C, due to the resistance of the fabric, and this bending moment is compensated for by adjusting the distance of the diving stroke of the piston. This adjustment means is provided by a stop shoe 29 secured at a free end of a threaded member 30 and disposed in facial alignment with a front wall 22' of the movable needle support member 22 whereby to adjust the distance therebetween. A knob 31 is provided at the opposed end of the threaded member 30 to adjust the distance between the outer face 20' of the shoe and the outer face 22' of the support member 22. Accordingly, the protruding distance of the pointed end 28 of the needles 18 out of the flat picker surface 17 is adjusted. Depending on the need, the needle may be adjusted to pick two or more upper ones of the fabric pieces from a stack by adjusting the protruding distance of the needle.

As shown in the application of the picking and separating device as illustrated in FIG. 1, the picker mechanism 14 is hingedly secured to the pivot pin 15 whereby the fabric engaging foot member 16 may be tilted upwardly in the direction of arrow 32 after the needles have penetrated the upper ply(s) of the material stack 12. This serves to free the ends of the uppermost fabric pieces from their underlying pieces, and further stretch the material when two picker devices 10 are secured to a frame, one at opposed ends of the fabric pieces. This upward motion of the fabric engaging foot member 16 in the direction of arrow 32 is achieved by connecting the picker mechanism frame to a cylinder 33. FIG. 1 illustrates the picker mechanism in such position with the upper ply having been hinged upwardly above the underlying plies 11'. A pressing plate 34 may also be secured to the picker mechanism frame 14' to assist the foot 16 in pressing down on the fabric stack to maintain the upper ply in position not to disturb the stack, and provide for proper penetration of the needles in the upper ply. After the upper ply is engaged as shown in FIG. 1, the entire frame 13 is then lifted upwardly or the stack downwardly taking with it the upper engaged fabric ply.

Figure 4A:
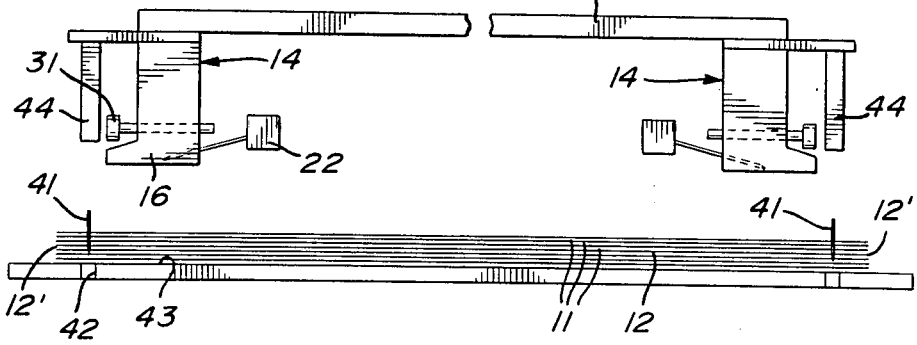
FIGS. 4A through 4D are schematic illustrations showing the picking and separating device as utilized in one of its applications with a free descending needle to increase the retention of the remaining plies.
Figure 4B:
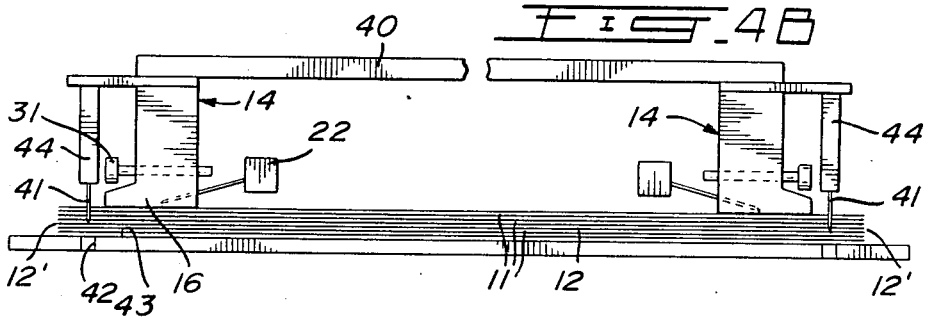
Figure 4C:
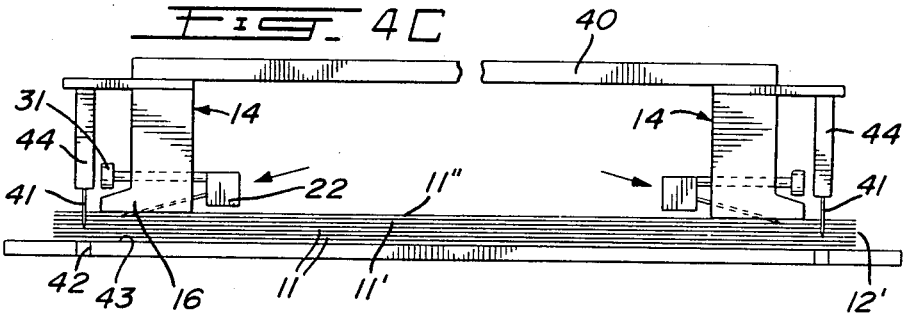
Figure 4D:
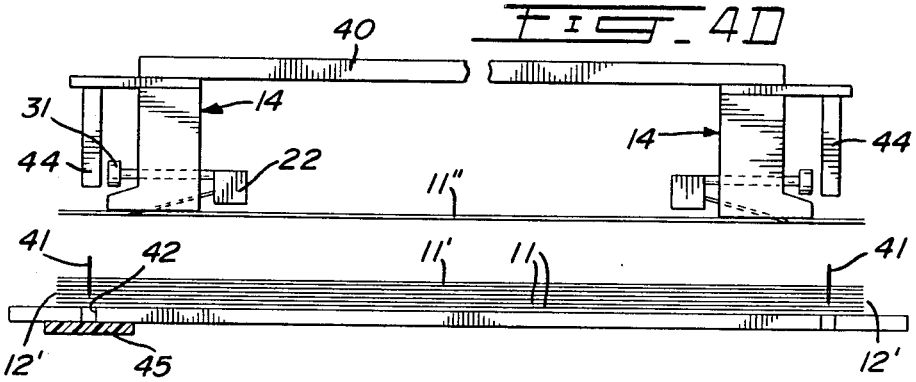

Referring now to FIGS. 4A to 4D, there is show a typical application of the picker mechanism 14 and, as herein shown, there are two such mechanisms secured in a spaced apart relationship with the needles of each picker mechanism extending away from one another in outwardly opposite directions. The picker mechanisms are secured to a common frame 40 which is displaceable vertically in a plane above a stack 12 of fabric pieces 11. As herein shown, a free descending needle 41 is disposed adjacent the outer ends 12' of the fabric stack and extends through a plurality of the upper plies. These needles 41 are aligned with a bore 42 provided in a stack supporting surface 43. The picking and separating device as herein shown in further provided with a free descending needle contacting member 44 whereby, during the picking stroke as illustrated in FIG. 4B, the contacting member 44 will press down on the needle 41 which will penetrate progressively downwardly as the picking process is performed. These free descending needles 41 provide the necessary resistance to the fabric pieces whereby to prevent the underlying fabric piece, i.e. 11' as shown in FIG. 4C, from adhering to the uppermost fabric piece 11'' by static or friction. Accordingly, in the withdrawing stroke as shown in FIG. 4D, only the upper ply 11'' will be carried away with the underlying plies 11' being retained in their stacked position. Furthermore, the function of the free descending needle is to maintain the perfect stack alignment during the handling of the stack from the material cutting operation to the picking and the separation of the uppermost plies. A needle engaging element, such as a cork 45 or other such means, may be positioned in or under the bores 42 whereby the needle will be retained thereby when descended in the boxes 42 to maintain the bottom fabric plies in the stack until the end of the stack is reached.

Figure 5A:
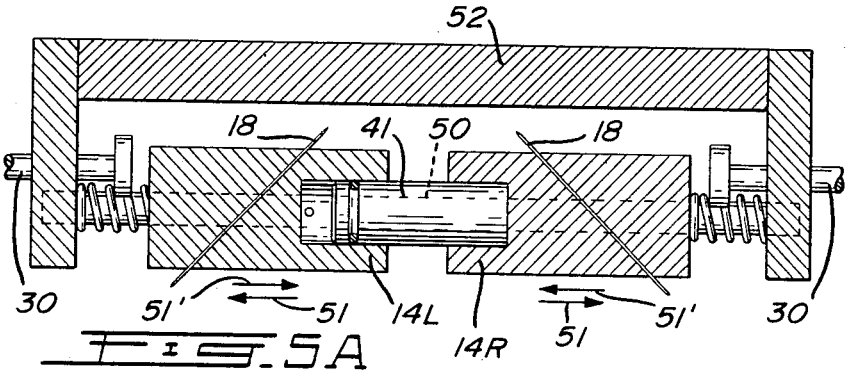
FIG. 5A is a schematic view of another picking and separating device.
Figure 5B:
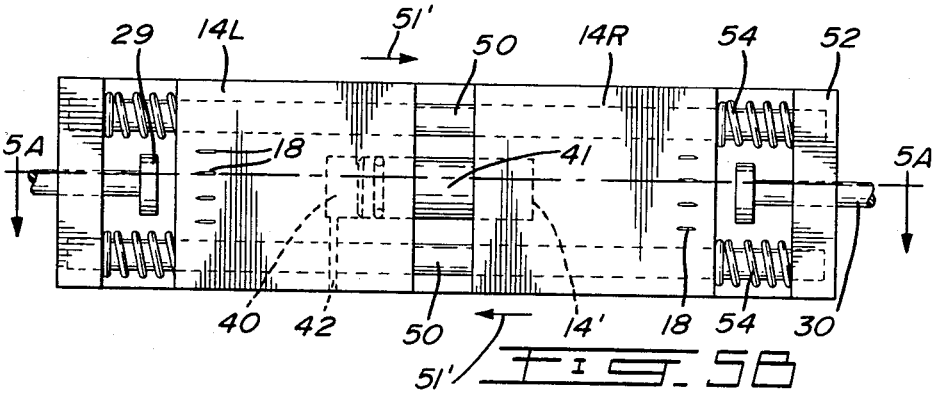
FIG. 5B is an enlarged bottom view of part of FIG. 5A.

FIGS. 5A and 5B show yet another picker mechanism which consists of reciprocating blocks 14L and 14R on which a plurality of angulated needles are fixed firmly outwardly in opposite direction. The reciprocating motion along direction 51 is guided by means of a sliding guide or horizontal support rods 50 and wherein the picker blocks 14L and 14R are adjustably displaced to engage the fixed needle 18 and to stretch the top fabric ply in the direction of arrows 51 engaging a predetermined number of the uppermost plies of the fabric pieces from a stack of fabric pieces. To separate the predetermined number of plies without disturbing the underlying fabric plies, as shown in FIGS. 4A to 4D, the reciprocating motion can be provided by an associated piston 41 (see FIG. 5) fixed on one of the two blocks 14L or 14R reciprocating in a bore 14'' in the block 14R. When pressurized air is applied through port 42 in block 14L, the blocks separate (displace) to engage the needles into a predetermined number of uppermost plies to engage them. Releasing the engaged separated material at a predetermined location can be provided by simply exhausting the air through port 42. The two reciprocating blocks 14L and 14R will slide inward in the direction of arrow 51' under the force of the four expanding springs 54 removing the stretching force which is the holding force, thus disengaging the material from the needles and causing the material to fall in a predetermined location. Obviously, such reciprocating motion of the two blocks 14L and 14R can be provided by an external piston means (not shown) or by a lever mechanism or by mechanical cam means, also not shown. The number of plies required to be separated depend on the adjusted length of the extended needle tips beyond the lower surface of the picking block.

The two previous methods can be combined to provide a third method separating a single or multiple plies from a stack. If we combine the diving needle principle of FIG. 1 with a swivelling mechanism together with the expanding reciprocating blocks of FIGS. 5A and 5B, the blocks of this third method would press on the surface 11′ of the stack, and progressively in sequence the needles 18 advance to penetrate through a predetermined number of plies. Thereafter, the two mechanisms slide outwardly in the direction of arrow 51 and then swivel upwardly. The two mechanisms are then lifted from the stack or the stack lowered whereby a predetermined number of plies only will be separated.

Figure 6A:
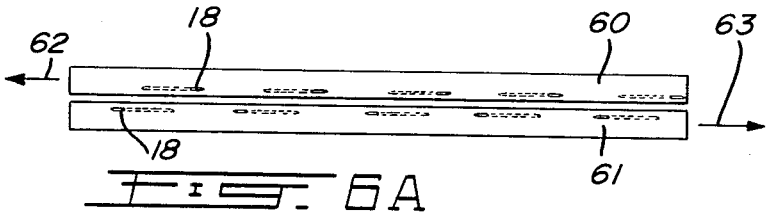
FIGS. 6A and 6B are schematic top and side views, respectively, illustrating a still further application of the picking and separating device.
Figure 6B:
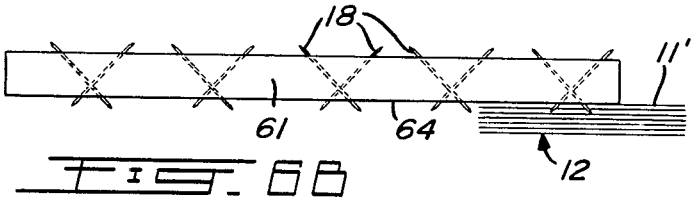

Referring now to FIGS. 6A and 6B, there is shown a still further example of the construction of a picking and separating device using the picker mecahnism of the present invention. As herein shown, the device is comprised of two elongated bars 60 and 61, each having a plurality of spaced needles 18, preferably but not exclusively, equidistantly spaced in a common alignment and extending in a common direction in association with its elongated bar. However, the needles of one bar are all aligned to point in the opposite direction as the needles of the other bar. Accordingly, by displacing both bars in the direction of arrows 62 and 63, with the picker surface 64 disposed over a material stack 12, it can be seen that the upper ply 11′ will be solidly engaged by a plurality of such needles applying retention force in opposite directions. The frame (not shown) is then lifted by suitable means to transfer the top ply 11′ from the stack 12.

Broadly described, the method of operation of the picker mechanism of the present invention comprises supporting the picker mechanism on a frame and moving the mechanism against the top ply of a stack of fabric plies with a flat picking surface applying pressure on the stack. A plurality of diving needles are then moved into the top ply or plies through the picking surface to engage these and the mechanism is them moved upwardly to transfer the top ply(s). In a variant of this design, the flat picker surface of the picker mechanism is provided in the form of a shoe which is pivoted upwardly to release the end portion of the top fabric piece from the underlying fabrics to separate same prior to withdrawing the mechanism from the stack. In a still further embodiment, free descending pins may extend through the stack to provide friction to the underlying fabric pieces to ensure proper separation of the engaged top fabric ply from the stack. In still further embodiments, the picker mechanism may be reciprocated in a common plane to stretch the upper ply to provide proper securement or the needles may be provided on bars with needles of one bar which are positioned side by side with the needles of one bar extending in one direction and the needles of the other bar in the other direction, the fabric is engaged in a plurality of picking areas therealong to provide for positive securement of the upper ply prior to transferring same.

The concept of the present invention can be described as follows:

Assume pressing firmly with a metal plate on a stack of fabric material, if the pressing metal plate has a slot 1/16″ wide through which a thin and flexible regular sewing needle can pass through freely, assuming the angle of the needle point is ($\alpha$°), is while pressing the stack with the above mentioned plate we hold the shank of the needle firmly and try to penetrate the needle in the uppermost plies through the slot at an inclination angle ($\alpha/2+3°$). As the needle advances to penetrate further plies, the resistance "penetration friction" will deflect the needle, as shown in FIG. 3C. When the deflection angle reaches more than 3°, the needle end will slide on top of the next top ply, the ply beyond the designated number of plies required to separate.

If we assume that

"P" is the pressure applied on top of material stack by the pressing plate, "L" the length of the needle, "d" the diameter of the needle, "$\beta$" the inclination angle of the needle "$\beta=\alpha/2+3°$, "f" the friction and the penetration resistance of the material, "T" the thickness of the material, "S" the allowed advancing distance of the needles, "n" the number of plies required to separate, then if "P", "L", "d" and "$\beta$" are constant therefore the characteristics of the material and the number of plies will determine the advancing distance "S".

In other words, depending on the characteristics of the material "f" "T", we can determine the number of plies "n" to be separated by adjusting the advancing distance "S" of the needles.

It is within the ambit of the present invention to cover any other obvious modifications of the picking and separating device using the picker mechanism of the present invention provided such modifications fall within the scope of the appended claims.

I claim:

1. A picking and separating device for picking one or more upper ones of a sheet-like material from a stack, said device comprising a frame, a picker mechanism secured to said frame, said mechanism having a fabric engaging member having a flat picker surface for applying pressure on a top surface of said stack, a plurality of angulated aligned needles secured to a movable needle support member and movable in and out of said top surface of said stack along an angulated fixed axis for engaging one or more upper ones of said sheet-like material in a stack of sheet-like material, means to displace said support member along said angulated fixed axis, adjustment means to adjust the displacement distance of said needles whereby to adjust the protruding distance of the needle picking ends extending through said flat picker surface, there being two of said picker mechanisms secured to said frame in a spaced apart relationship with said needles of said two picker mechanisms extending away from one another in outward opposite directions, said frame being provided with a free needle contacting member positioned outwardly of each said two picker mechanisms, a free descending needle positioned in said stack of fabric pieces from a top end thereof, said descending needles being advanced in said stack progressively by downward movement of said frame during each picking cycle to provide resistance to the fabric pieces to prevent underlying fabric pieces from adhering to an uppermost engaged fabric piece.

2. A device as claimed in claim 1 wherein said picker mechanism is hingedly secured to said frame on a pivot axis, and wherein there is further provided means to upwardly tilt said picker surface on said picker axis.

3. A device as claimed in claim 1 wherein said sheet-like material stack is a stack of fabric plies.

4. A device as claimed in claim 3 wherein each said needle has a securement end receivable in a respective one of a plurality of equidistantly spaced securing bores in said movable needle support member, means to removably secure each said needles in their respective securing bores, said flat picker surface having a plurality of equidistantly spaced slots to receive a needle end portion of respective ones of said plurality of needles therein.

5. A device as claimed in claim 4 wherein said means to displace said movable support frame is a piston connected to said movable support frame.

6. A device as claimed in claim 5 wherein said movable support frame is guided along said angulated fixed axis by a pair of guide pins extending through a respective guide bore in said movable support frame.

7. A device as claimed in claim 4 wherein said means to displace said picker surface is located at a lower extremity of a foot member, said foot member having a vertical wall extending above said flat picker surface, said means to displace said picker surface being a piston having a piston rod end hingedly secured to said vertical wall to displace same on said pivot axis to cause said picker surface to tilt upwardly from said stack of fabric plies.

8. A device as claimed in claim 7 wherein said adjustment means comprises a threaded member extending through said vertical wall and having an arresting free end, said arresting free end extending through said vertical wall and in alignment with an abutment wall portion of said movable support frame to limit the travel distance of each needle end portion through their slot in said flat picker surface.

9. A device as claimed in claim 1 wherein said frame is secured to displacement means for moving same along a vertical plane.

10. A device as claimed in claim 1 wherein there is further provided a support frame having slidable support means, two of said picker mechanisms each having their frame displaceably and adjustably secured to said support means in spaced apart relationship with said needles of said two picker mechanisms extending away from one another in outward opposite directions.

11. A device as claimed in claim 1 wherein said stack of fabric pieces is supported on a support surface having a cavity disposed in alignment with each said descending needles, and means to retain said descending needles upright in said cavities.

12. A device as claimed in claim 1 wherein said frame is an elongated bar having a plurality of said needles disposed in alignment therealong and all angulated in the same direction, there being two of said elongated bars secured in close side parallel relationship and displaceable in opposite directions, the needles of said bars being oriented in opposite directions.

13. A method of separating, picking and transporting one or more upper ones of sheet-like material from a stack of such material, said method comprising:

(i) providing a frame having a picker mechanism with a plurality of aligned angulated needles movable in and out of a top surface of said stack;

(ii) effecting relative movement of said frame and said top surface of said stack to apply pressure against an upper one of said sheet-like material in said stack;

(iii) penetrating said needles at a picking angle to engage predetermined upper ones of said sheet-like material in said stack; and (iv) effecting relative displacement between said frame and said top surface to discharge said uppermost sheets engaged by said needles, said sheet-like material stack being a stack of fabric plies, there being two of said picker mechanisms secured to said frame in a spaced apart relationship with said needles of said two picker mechanisms extending away from one another in outward opposite directions, and wherein there is further provided the steps of (v) positioning a free descending needle in said fabric stack from a top end thereof; and (vi) advancing said descending needles when said step (ii) is performed whereby to provide resistance to said underlying fabric plies not engaged by said needles to prevent underlying fabric pieces from adhering to an uppermost engaged fabric piece.

14. A method as claimed in claim 13 wherein said step (iii) further comprises stretching said engaged sheets.

15. A method as claimed in claim 13 wherein said step (iii) comprises tilting a picker mechanism picker surface having said needles protruding therefrom to effect said stretching.

16. A method as claimed in claim 13 wherein after said step (i) there is further provided the step of adjusting the travel distance of said needles out of a fabric engaging surface of said picker mechanism.

17. A method as claimed in claim 13 wherein there are two picker mechanisms each having said needles fixed thereto and extending at angles away from one another in outward opposite directions, said step (iii) comprising displacing said two picker mechanisms away from one another in a common plane parallel to said top sheetlike material of said stack to effect said penetration of said needles and stretching of said sheet-like material sheets to be engaged and separated.

* * * * *